US005822657A

United States Patent [19]

Hisada et al.

[11] Patent Number: 5,822,657

[45] Date of Patent: Oct. 13, 1998

[54] IMAGE FORMING APPARATUS

[75] Inventors: Hidenori Hisada, Tokoname; Ikunobu Yoshiyama, Anjo, both of Japan

[73] Assignee: Brother Kogyo Kabushiki Kaisha, Nagoya, Japan

[21] Appl. No.: 831,479

[22] Filed: Mar. 31, 1997

[30] Foreign Application Priority Data

May 16, 1996 [JP] Japan ..... 8-122030
May 16, 1996 [JP] Japan ..... 8-122031

[51] Int. Cl.[6] ..... G03G 15/30

[52] U.S. Cl. ..... 399/149; 399/343; 399/358

[58] Field of Search ..... 399/148–150, 399/358, 359, 349, 343, 71

[56] References Cited

U.S. PATENT DOCUMENTS

| | | | |
|---|---|---|---|
| 3,914,045 | 10/1975 | Namiki et al. | 399/149 |
| 4,763,168 | 8/1988 | Lindblad | 399/359 |
| 4,769,676 | 9/1988 | Mukai et al. . | |
| 5,124,757 | 6/1992 | Ikegawa | 399/148 |
| 5,200,789 | 4/1993 | Oshiumi | 399/18 |
| 5,282,007 | 1/1994 | Oshiumi | 399/150 |
| 5,333,041 | 7/1994 | Ito et al. | 399/149 |
| 5,438,397 | 8/1995 | Okano et al. . | |
| 5,587,774 | 12/1996 | Nagahara et al. | 399/150 |
| 5,610,697 | 3/1997 | Arai | 399/149 |
| 5,678,143 | 10/1997 | Nagahara et al. | 399/150 |
| 5,701,570 | 12/1997 | Takuma | 399/149 X |
| 5,740,494 | 4/1998 | Shoji et al. | 399/71 |

*Primary Examiner*—Matthew S. Smith
*Attorney, Agent, or Firm*—Oliff & Berridge, PLC

[57] ABSTRACT

An image forming apparatus is provided that includes a photosensitive drum; a laser scanner unit; a developing roller; a transfer roller; and a cleaning device. The cleaning device absorbs residual toner left on the surface of the photosensitive drum after a transfer process from the surface of the photosensitive drum by using a potential difference from the photosensitive drum in an absorption mode and for blowing off and dispersing the absorbed toner to the surface of the photosensitive drum by using another potential difference from the photosensitive drum in a blowing-off mode. The apparatus further includes a first power supply that provides a first voltage different from an electric potential of the ground to the cleaning device; a second power supply that provides a second voltage different from the electric potential of the ground and different from the first voltage to the photosensitive drum; and a switch for switching the image forming apparatus to the absorption mode by connecting the cleaning device to the ground and for switching the image forming apparatus to the blowing-off mode by connecting the cleaning device to the first power supply.

19 Claims, 5 Drawing Sheets

Fig.5A DEVELOPMENT PROCESS
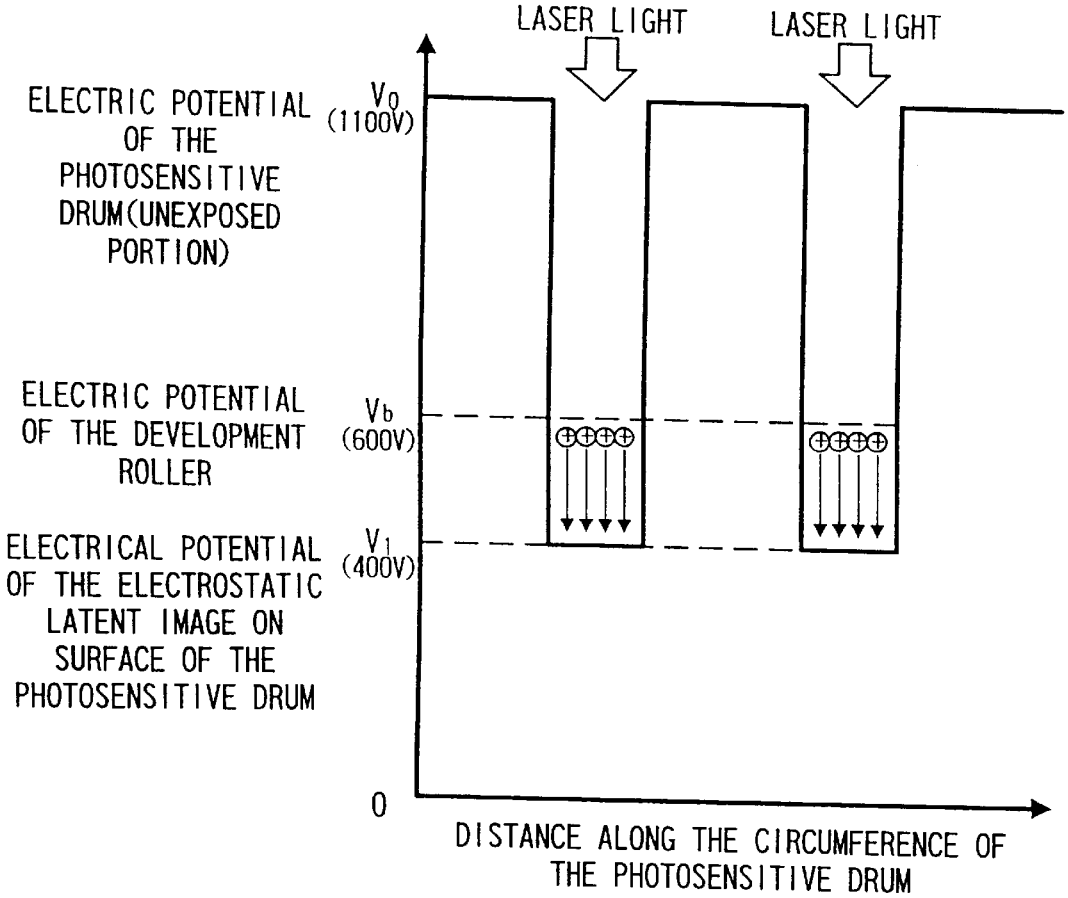
Fig.5B CLEANING PROCESS
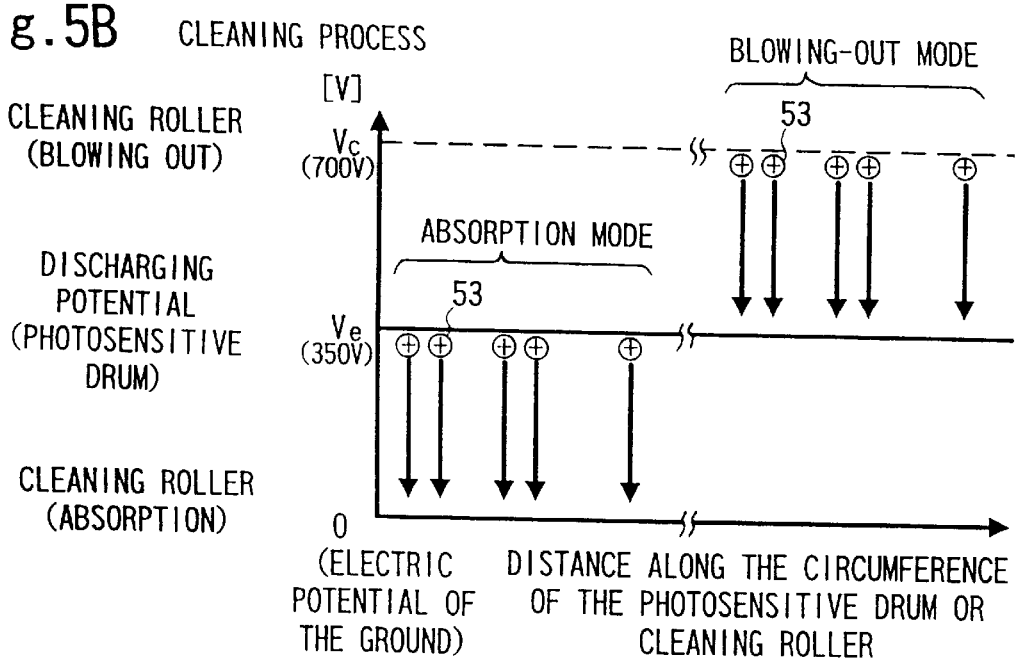

IMAGE FORMING APPARATUS

BACKGROUND OF THE INVENTION

1. Field of the Invention

In general, the invention relates to an image forming apparatus such as a printer, a copy machine or a facsimile. In particular, the invention relates to an image forming apparatus adopting electrophotography wherein a cleanerless method is used for collecting developing agent left on the surface of a photosensitive drum by a developing device for recycling.

2. Description of the Related Art

In the conventional image forming apparatus adopting the electrophotographic method of this type, in general, the developing process is carried out using toner electrostatically charged to a negative or positive polarity on the surface of a photosensitive drum on which an electrostatic latent image has been formed by using electric charging and exposing processes. The toner image formed on the surface of the photosensitive drum by the developing process is transferred onto recording paper by a transfer roller. In areas on the surface of the photosensitive drum completing the transfer process, some residual toner is left depending upon the concentration of the formed toner image. When the areas of the surface of the photosensitive drum on which the residual toner is left undergo electric charging, latent image forming, developing and transferring processes in the next cycle, portions contaminated with the residual toner are formed on the recording paper, leading to deterioration of the quality of the image formed on the recording paper.

For this reason, a cleaner such a blade for wiping off the residual toner from the surface of the photosensitive drum is provided in the conventional image forming apparatus. As an alternative, the residual toner can be collected by the cleanerless method for return to the developing device for recycling without the use of a cleaner.

In the cleanerless method, a dispersion device such as a cleaning roller or a cleaning brush for electrically absorbing and blowing the residual toner is provided on the downstream side of the transfer roller with respect to the rotational direction of the photosensitive drum. While a latent image is being formed on the surface of the photosensitive drum, the dispersion device absorbs the residual toner from the surface of the photosensitive drum by means of an electrical absorbing force in an absorption mode. Then, during the period of time when a latent image is not formed, the residual toner is blown off the dispersion device to be dispersed onto the surface of the photosensitive drum in a blowing-off mode. The dispersed toner is returned to the developing device for recycling by the rotating photosensitive drum.

To carry out the functions described above, the dispersion device has a first power supply for generating a first potential difference from the photosensitive drum. The first potential difference is used for absorbing the residual toner from the surface of the photosensitive drum in the absorption mode. The dispersion device also has a second power supply for generating a second potential difference from the photosensitive drum. The second potential difference is used for blowing the absorbed toner off the dispersion device and onto the surface of the photosensitive drum in the blowing-off mode. A switch is used for selectively connecting the first or second power supply to the dispersion device. Such a structure is disclosed in U.S. Pat. Ser. No. 5,438,397, which is hereby incorporated by reference.

For example, if the surface electric potential of the photosensitive drum completing the electrical-charging, latent image forming, developing and transferring processes is +50V, then the electric potential of the first power supply for use in the absorption mode of the dispersion device is −300V. This provides a potential difference of −350V between the photosensitive drum and the first power supply. The potential difference causes residual toner left on the surface of the photosensitive drum to be absorbed to the dispersion device. On the other hand, if the electric potential of the second power supply for use in the blowing-off mode of the dispersion device is +400V, a potential difference of +350V is provided between the photosensitive drum and the second power supply. The potential difference causes the toner absorbed to the dispersion device to be blown off the dispersion device onto the surface of the photosensitive drum.

According to the cleanerless method using the dispersion device as described above, it is possible to prevent the deterioration of the image quality of the image formed in the subsequent cycle caused by the residual toner left on the surface of the photosensitive drum after the transfer process. Further, the residual toner can be collected for recycling for use in a subsequent developing process. As a result, the cleanerless method is very advantageous.

According to the cleanerless method described above, however, it is necessary to provide different polarity voltages to the dispersion device in the two modes respectively, the absorption mode and the blowing-off mode. Thus, two kind of power supplies, a positive power supply and a negative power supply, are required, causing the image forming apparatus to be large in size and complex as well as expensive.

Further, according to the development method where the developing roller and the photosensitive drum are brought into contact with each other, at the time the power supply of the image forming apparatus is turned on, the surface electric potential of the developing roller is the same as that of the photosensitive drum. To be more specific, both the surface electric potentials are 0 V. During the time when the surface electric potential of the photosensitive drum is approaching a predetermined bias value, development by using toner is inadvertently carried out on a portion of the surface of the photosensitive drum where an electrostatic latent image is not formed. When the portion to which the toner is adhered rotates to a position facing the transfer roller, the recording paper has not yet been fed. As a result, the toner on the surface of the photosensitive drum is adhered to the transfer roller, contaminating the roller. The toner contaminating the transfer roller is then adhered to the back surface of the recording paper fed afterward, contaminating the paper as well.

SUMMARY OF THE INVENTION

The invention addresses the problems described above. It is an object of the invention to provide an image forming apparatus capable of operating with only one power supply for a dispersion device thereof and reducing the risk of the deterioration of the image quality due to an unnecessary developing process occurring at a power-on time.

In order to achieve the object described above, a preferred embodiment of the invention provides an image forming apparatus comprising a photosensitive body; a latent image forming device that forms an electrostatic latent image on a surface of the photosensitive body; a developing device that forms an image on the surface of the photosensitive body by developing the electrostatic latent image by using a developing agent electrically charged to a predetermined polarity in an operative state and for collecting the developing agent dispersed on the surface of the photosensitive body for recycling in an inoperative state; and a transfer device that transfers the image to a recording medium. The apparatus further includes a dispersion device that absorbs developing agent left on the surface of the photosensitive body after the transfer process from the surface of the photosensitive body by using a potential difference from the photosensitive body in an absorption mode and for blowing off and dispersing the absorbed developing agent to the surface of the photosensitive body by using another potential difference from the photosensitive body in a blowing-off mode; a first power supply that provides to the dispersion device a first voltage different from an electric potential of the ground; a second power supply that provides to the photosensitive body a second voltage different from the electric potential of said ground and different from the first voltage; and a switching device for switching the image forming apparatus to the absorption mode by connecting the dispersion device to the ground and for switching the image forming apparatus to the blowing-off mode by connecting the dispersion device to the first power supply.

According to the image forming apparatus of the preferred embodiment, an electrostatic latent image is formed on the surface of the photosensitive body by the latent image forming device. Then, the developing device is used for forming an image on the surface of the photosensitive body by developing the electrostatic latent image by using developing agent electrically charged to a predetermined polarity. Subsequently, the transfer device is used for transferring the image to a recording medium. Then, the dispersion device is used for absorbing developing agent left on the surface of the photosensitive body after a transfer process by using a potential difference from the photosensitive body in the absorption mode and for blowing off and dispersing the absorbed developing agent to the surface of the photosensitive body by using another potential difference from the photosensitive body in the blowing-off mode.

The switching device is used for switching the image forming apparatus to the absorption mode by connecting the dispersion device to the ground voltage (typically, a 0V voltage is supplied to the dispersion device as the ground voltage), and for switching the image forming apparatus to the blowing-off mode by connecting the dispersion device to the first power supply (typically, a +700V voltage is supplied to the dispersion device as the first voltage). In this case, the second voltage which has a typical value of +300V, a value different from the electric potential of the ground voltage and the first IS voltage, is supplied to the photosensitive body. As a result, in the absorption mode, developing agent left on the surface of the photosensitive body after the transfer process is absorbed to the dispersion device by a potential difference between the ground voltage and the second voltage plus the electric potential of the electrostatic latent image which has a typical value of +50V. The potential difference in the absorption mode is thus 0V−(300V +50V)= −350V.

In the blowing-off mode, on the other hand, the developing agent absorbed by the dispersion device is blown off and dispersed from the dispersion device to the surface of the photosensitive body by a potential difference between the first voltage of the first power supply relative to the ground potential and the second voltage plus the electric potential of the electrostatic latent image. The potential difference in the blowing-off mode is thus 700V−(300V +50V)= +350V. Finally, in an inoperative state, the developing device collects the developing agent dispersed on the surface of the photosensitive body for recycling In this way, the cleaning process is carried out by adopting the cleanerless method using only one power supply, that is, the first power supply for the dispersion device.

In addition, the second voltage from the second power supply is applied to the photosensitive body. Thus, the developing agent from the developing device will no longer be adhered to the surface of the photosensitive body due to a potential difference between the developing device and the photosensitive body, during the time when the surface electric potential of the developing roller is approaching a predetermined bias value, after the power supply of the image forming apparatus is turned on. Therefore, unnecessary developing process never occurs at a power-on time. As a result, the transfer device will not be contaminated by the developing agent, allowing a poor printing quality due to the contamination to be avoided and, thus, allowing a high quality image to be formed.

Additionally, a third power supply for supplying a third voltage different from the ground electric potential to the developing device can be provided during the developing process. The third voltage can be applied to the developing device by the third power supply during the developing process. The potential difference between the third power supply and the second power supply supplying power to the photosensitive body is used as a development bias voltage, allowing an electrostatic latent image to be developed appropriately on the surface of the photosensitive body by the developing device in an operative state.

Also, the second power supply can employ a current-to-voltage conversion device. Employing a current-to-voltage conversion device such as a varister, the second power supply can be designed at a low cost. As a result, the image forming apparatus also has a low cost as well.

Further, the dispersion device can include either a cleaning roller or a cleaning brush facing the surface of the photosensitive body. Since the dispersion device has either a cleaning roller or a cleaning brush facing the surface of the photosensitive body, the developing agent left on the surface of the photosensitive body can be wiped off by the dispersion device.

Furthermore, a discharging device for eliminating the residual electric charge left on the surface of the photosensitive body after a transfer process can be provided between the transfer device and the dispersion device. With this structure, the residual electric charge left on the surface of the photosensitive body is eliminated by the discharging device provided between the transfer device and the dispersion device. Thereafter, in the absorption mode, the developing agent left on the surface of the photosensitive body after the transfer process is absorbed to the dispersion device by a potential difference from the photosensitive body, and in the blowing-off mode, the developing agent absorbed by the dispersion device can be blown off and dispersed from the dispersion device to the surface of the photosensitive body by another potential difference from the photosensitive body. Then, in an inoperative state, the developing device collects the developing agent dispersed on the surface of the photosensitive body for recycling.

Since the electric charge is eliminated by the discharging device at a stage prior to the blowing out of developing agent by means of the dispersion device, the blowing-off operation is carried out on the photosensitive body completing the elimination of electric charge. Accordingly, the surface electric potential of the photosensitive body completing the elimination of electric charge is stable regardless of whether the surface is an exposed area or a non-exposed area. As a result, since a difference between a stable electric potential of the surface of the photosensitive body completing the elimination of electric charge and the dispersion electric potential of the dispersion device is used, a stable blowing-out operation can be carried out.

Also, the discharging device can eliminate the electric charge from the surface of the photosensitive body so that the surface electric potential of the photosensitive body becomes lower than the electric potential of the electrostatic latent image. Since the discharging device eliminates the electric charge from the surface of the photosensitive body so that the surface electric potential of the photosensitive body becomes lower than the electric potential of the electrostatic latent image, the blowing-off operation can be carried out by the dispersion device. As a result, the state of the photosensitive drum can be maintained, allowing a high quality image to be formed.

Additionally, the discharging device can employ a discharging lamp provided between the transfer device and the dispersion device facing the surface of the photosensitive body. Since the discharging lamp is provided between the transfer device and the dispersion device, facing the surface of the photosensitive body, it can eliminate electric charge from the surface of the photosensitive drum without regard to whether the residual toner exists and whether an exposure electric potential exists, resulting in a uniform electric-potential distribution. As a result, the state of the photosensitive drum at the time developing agent is removed from the surface thereof is good, allowing a high quality image to be formed.

BRIEF DESCRIPTION OF THE DRAWINGS

These and other aspects and advantages of the invention will become apparent from the following detailed description of a preferred embodiment when taken in conjunction with the accompanying drawings, in which:

FIGS. 5A and 5B are diagrams showing a variety of electric potentials observed during development and cleaning processes carried out in the laser beam printer of FIG. 1.

DETAILED DESCRIPTION OF THE PREFERRED EMBODIMENTS

Figure 1:
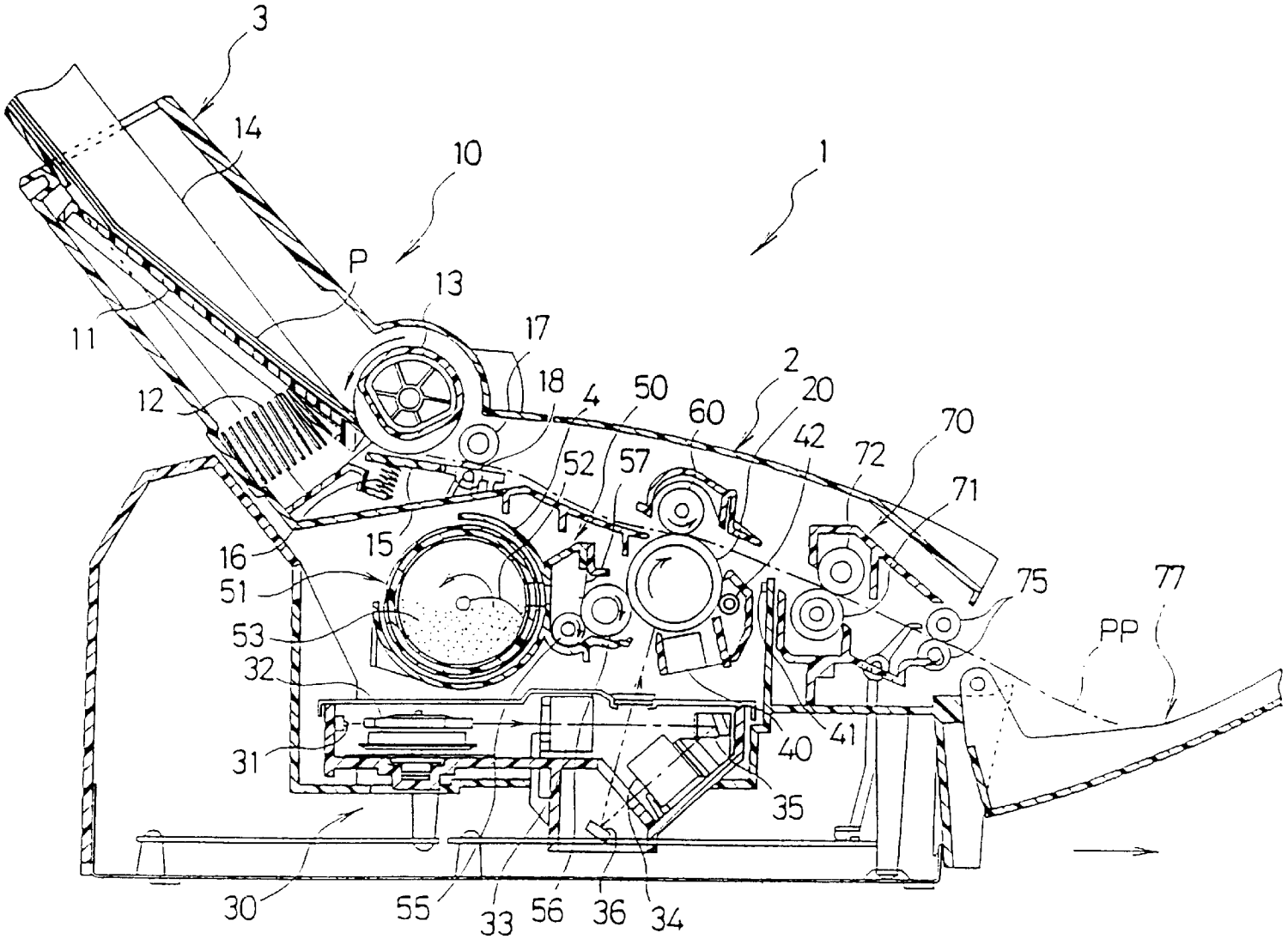
Fig. 1 is a side cross-sectional view of a laser beam printer according to a preferred embodiment of the invention.

While the invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

For a general understanding of the features of the invention, reference is made to the drawings. In the drawings, like reference numerals have been used throughout to designate identical elements.

FIG. 1 is a side cross-sectional view of a laser beam printer 1 according to a preferred embodiment of the invention. The laser beam printer 1 includes a main-body case 2, a feeder 10 for supplying paper P on which an image is to be printed, photosensitive drum 20 on which processes for forming an image such as electric charging, development, transfer and collection of residual toner for recycling are carried out sequentially one after another, a fixing device 70 for fixing an image transcribed from the surface of the photosensitive drum 20 to the paper P and a discharge paper tray 77 for receiving the discharged paper P with the image fixed thereon conveyed along a conveying path PP.

The laser beam printer 1 also has a driving device (not shown) which rotates the photosensitive drum 20. The laser beam printer 1 also includes other components arranged sequentially along the circumference of the photosensitive drum 20. Such other components include laser scanner 30, developing device 50, transfer roller 60, cleaning roller 42, discharge lamp 41 and electric charger 40 as discussed below.

The laser scanner 30 forms an electrostatic latent image on the surface of the photosensitive drum 20 rotated by the driving device as described above. The developing device 50 includes a developing roller 56 for developing the electrostatic latent image formed on the surface of the photosensitive drum 20 by toner. The transfer roller 60 transcribes the toner image developed on the surface of the photosensitive drum 20 to the paper P. The cleaning device 42 returns residual toner left on the surface of the photosensitive drum 20 after a transfer process has been carried out by the transfer roller 60 to the developing device 50 for recycling. The residual toner is returned to the developing device 50 by the photosensitive drum 20 with predetermined timing. The cleaning device 42 temporarily absorbs the residual toner from the surface of the photosensitive drum 20 and then blows off and disperses the absorbed toner onto the surface of the photosensitive drum 20.

The discharging lamp 41 eliminates residual electric potentials left on the surface of the photosensitive drum 20 after a transfer process carried out by the transfer roller 60. The electric charger 40 then electrically charges the photosensitive drum 20 after the elimination of the residual electric potentials so as to allow an electrostatic latent image to be formed on the surface of the photosensitive drum 20.

Next, the components of the laser beam printer 1 are explained in detail with reference to FIGS. 1 to 3.

As shown in FIG. 1, the feeder 10 includes a paper pressing plate 11 having the same dimensions as the paper P. The paper pressing plate 11 is provided inside an upper feeder case 3 which is located on the rear part of the main body case 2. The paper pressing plate 11 is pivotably supported at the rear end thereof. At the front end of the paper pressing plate 11, a compressed spring 12 is provided. The compressed spring 12 elastically pushes the paper pressing plate 11 upward. A paper supply roller 13 extended in the lateral direction is rotatably supported by the paper pressing plate 11. The paper supply roller 13 is driven to rotate according to a paper-supply timing by a driving system (not shown).

The feeder 10 also has a paper cassette 14 which is mounted in an inclined orientation inside the feeder case 3 in such a way that the paper cassette 14 can be removed from and mounted to the feeder case 3 with ease. The paper cassette 14 accommodates a number of pieces of paper. The rotation of the paper supply roller 13 causes a piece of paper to be pulled out periodically from the top of the accommodated paper in the paper cassette 14 one after another.

The feeder 10 also has a separation member 15 provided beneath the paper supply roller 13 to separate only one piece of paper from the paper cassette 14 at a time. The separation member 15 is elastically pressed upward against the paper supply roller 13 by a compressed spring 16. A pair of resist rollers 17 and 18 are each rotatably supported downstream in the paper conveying direction, that is, the direction from left to right in FIG. 1, with respect to the paper supply roller 13. The resist rollers 17 and 18 are used for aligning the edge of the separated paper P.

Figure 2:
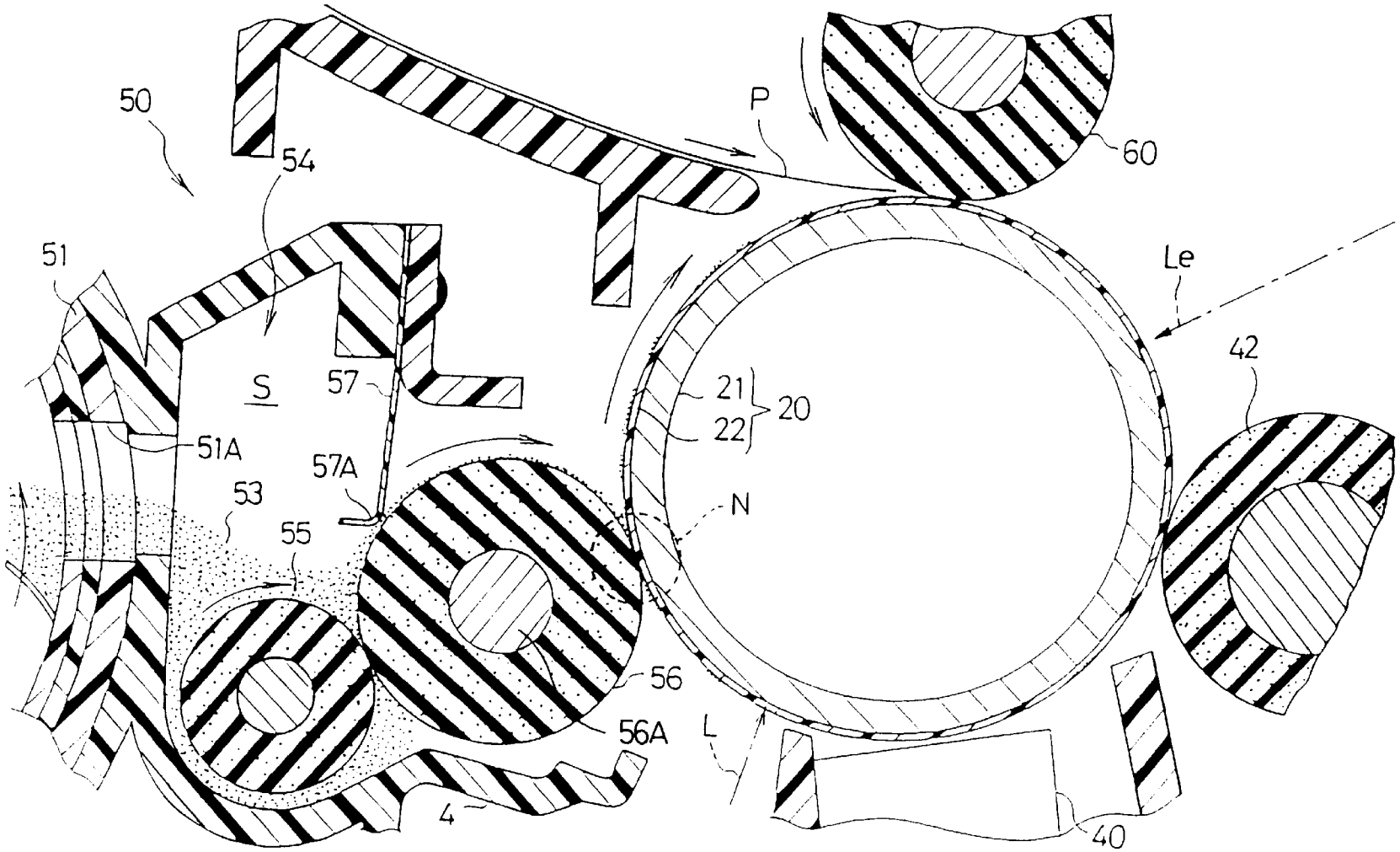
Fig. 2 is an enlarged side view of a developing unit and a photosensitive drum employed in the laser beam printer of FIG. 1.

The photosensitive drum 20 shown in FIGS. 1 and 2 is made of a material which is electrically charged to the positive polarity. An example of such a material is an organic photosensitive body having polycarbonate electrically charged to the positive polarity as a main component. Typically, the photosensitive drum 20 is a hollow drum which has a cylindrical sleeve 21 made of aluminum as shown in FIG. 2. On the outer surface of the cylindrical sleeve 21, a photo-conductive layer 22 having a predetermined thickness of typically about 20 microns is formed by diffusing photo-conductive resin into polycarbonate. With the cylindrical sleeve 21 connected to the ground, the photosensitive drum 20 is rotatably supported by the main body case 2. That is, for an electrostatic latent image with a positive polarity formed on the surface of the photosensitive drum 20, toner 53 with a positive polarity (that is, with positive electric charge) is developed by using an inverse development technique. The photosensitive drum 20 is driven to rotate about its axis by the driving device in a clockwise direction as shown in FIG. 1.

As shown in FIG. 1, the laser scanner 30 includes a laser generator 31 for generating laser beam L for forming an electrostatic latent image on the surface of the photosensitive drum 20, a rotary polygon mirror (a five-surface mirror) 32, a pair of lenses 33 and 34 and a pair of reflective mirrors 35 and 36 which are provided beneath the photosensitive drum 20.

A scorotron type electric charger 40 is typically provided for positive charging use. The electric charger 40 causes a corona-discharge phenomenon from an electric charging wire typically made of tungsten. In the preferred embodiment, the electric charger 40 is provided facing the photosensitive drum 20, but not contacting the surface of the photosensitive drum 20. As a result, the residual toner left on the surface of the photosensitive drum 20 does not adhere to the electric charger 40.

In the main body case 2, a discharging lamp 41, typically an LED, a EL (electric luminescence) or a fluorescent lamp, is provided at a location that allows a light generated thereby to be radiated to the surface of the photosensitive drum 20 completing a transfer process. To eliminate the residual electric charge left on the surface of the photosensitive drum 20 after the transfer process, the discharging lamp 41 radiates a light Le onto the surface of the photosensitive drum 20, including areas on which the residual toner 53 remains because it was not transferred from the surface of the photosensitive drum 20 to the paper P when the paper P passed through the transfer roller 60. The amount of the residual toner 53 is small in comparison with the amount of the toner 53 transferred to the paper P. In general, the former is smaller than about 10% of the latter. As a result, the surface of the photosensitive drum 20 is uniformly freed of the residual electric charge by the light Le regardless of whether the residual toner 53 is actually present.

A cleaning device 42, for example, a roller, is provided on the downstream side with respect to the direction of rotation of the photosensitive drum 20 of the discharging lamp 41. By changing a bias voltage, the cleaning device 42 is put in an absorption mode for temporarily absorbing the residual toner 53 left on the surface of the photosensitive drum 20 after a transfer process by the transfer roller 60, or in a blowing-off mode in which the absorbed toner 53 is blown off the cleaning device 42 and dispersed onto the surface of the photosensitive drum 20 with such timing that processes such as exposure, development and transfer to be carried out next on the photosensitive drum 20 are not disturbed.

As shown in FIGS. 1 and 2, the developing unit 50 has a toner box 51 with a cylindrical double-layer wall. The toner box 51 is mounted in such a way that it can be put into and removed from the developing case 4. The toner box 51 accommodates a rotary agitator 52 and electrically insulating toner 53 electrically chargeable to a positive polarity. In front of the toner box 51, a toner storage chamber 54 is formed. The toner storage chamber 54 is used for storing the toner 53 which is supplied from the toner box 51 thereto through a toner supply opening 51A by the rotation of the agitator 52.

The toner storage chamber 54 is formed with a large upper space S above a supply roller 55. As shown in Fig.2, the supply roller 55 is provided in the toner storage chamber 54 in such an orientation that the longitudinal axis thereof is parallel to a horizontal plane. In addition, the supply roller 55 is rotatably supported. A developing roller 56 is also provided. The longitudinal axis of the developing roller 56 is also parallel to a horizontal plane and rotatably supported in such a way that through the partitioned front side of the toner storage chamber 54 the developing roller 56 is brought into contact with both the supply roller 55 and the photosensitive drum 20.

The supply roller 55 is an electrically conductive cellular elastic body made of silicon rubber or urethane rubber. The resistance of a portion thereof in contact with the developing roller 56 is in a range of about $5\times10^4$ to $1\times10^9$ ohms. The developing roller 56 is an electrically conductive rigid roller made of silicon rubber or urethane rubber. By placing the developing roller 56 in contact with the surface of the photosensitive drum 20 as shown in FIG. 2, a nip N is formed. In the preferred embodiment, since the toner 53 is electrically charged to the positive polarity and the photosensitive drum 20 is made of an organic photosensitive substance having polycarbonate electrically charged to the positive polarity, urethane rubber is a very appropriate material for the developing roller 56.

At the center of the developing roller 56, an electrode 56A for applying a development bias voltage exists. The resistance of a resistor from the electrode 56A to the nip N on the circumference of the developing roller 56 is in the range of about $5\times10^4$ to $1\times10^7$ ohms. Further, the supply roller 55 and the developing roller 56 are arranged such that they are both driven by a driving mechanism (not shown) to rotate in the clockwise direction as shown by the arrows in FIG. 1.

In an operative state where a developing voltage Vb is applied, the developing roller 56 carries out a developing process on the surface of the photosensitive drum 20 by using the toner 53 electrically charged to the positive polarity. In an inoperative state where the ground is connected, on the other hand, residual toner 53 returned to the surface of the photosensitive drum 20 is collected by the cleaning device 42 and subsequently dispersed by the cleaning device 42 onto the photosensitive drum 20 to be transferred to the developing roller 56 for recycling.

Figure 3:
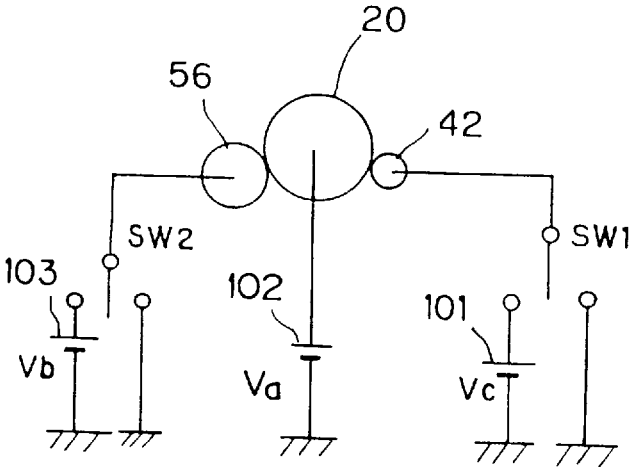
FIG. 3 is a diagram showing power supplies and switches employed in the laser beam printer of FIG. 1.

That is, a first power supply 101 and a switch SW1 are provided as shown in FIG. 3. The first power supply 101 and the switch SW1 are used for supplying a voltage Vc as a first voltage for controlling the absorption of the residual toner 53 to the cleaning device 42 and the blowing-off of the absorbed toner 53. By actuating the switch SW1, either the first voltage Vc generated by the first power supply 101 is applied to the cleaning device 42, or the cleaning device 42 is connected to the ground. The actuation of the switch SW1 is controlled by a microcomputer (not shown). In the absorption mode, the switch SW1 is connected to the ground, setting the electric potential of the cleaning device 42 at 0V. In the blowing-off mode, the switch SW1 is connected to the power supply 101, applying the first voltage Vc to the cleaning device 42.

In addition, as shown in FIG. 3, the photosensitive drum 20 is connected to a second power supply 102 for generating a voltage Va, a second voltage which serves as a drum offset voltage. Thus, the electric potential of the photosensitive drum 20 is always set at Va. The second power supply 102 employs a current-to-voltage conversion device such as a varister.

Further, the developing roller 56 is provided with a third power supply 103 and a switch SW2 as shown in FIG. 3. The third power supply 103 and the switch SW2 are used for supplying a voltage Vb as a third voltage for use in the developing process. By actuating the switch SW2, either the third voltage Vb generated by the third power supply 103 is applied to the developing roller 56, or the developing roller 56 is connected to the ground. The actuation of the switch SW2 is controlled by the microcomputer.

In an inoperative state where toner is to be collected by the cleaning device 42 for recycling, the switch SW2 is connected to the ground, setting the electric potential of the developing roller 56 at 0V. In an operative state where a developing process is to be carried out, the switch SW2 is connected to the third power supply 103, applying the third voltage Vb to the developing roller 56 as a developing bias.

The cleaning device 42 is an electrically conductive cellular elastic body typically made of silicon rubber, urethane rubber to which a variable bias voltage can be applied. The cleaning device 42 is provided to allow the developing roller 56 to collect the residual toner 53 for recycling with a high degree of efficiency. A cleaning brush can also be used for dispersing the residual toner 53 on the surface of the photosensitive drum 20 in addition to or instead of the roller shown in FIG. 2.

As shown in FIGS. 1 and 2, there is provided a layer-thickness regulating blade 57 in the developing case 4 facing downward. The layer-thickness regulating blade 57 has the property of elasticity displayed normally by a thin plate made of stainless steel or phosphor bronze. A curved portion 57A formed at the lower edge of the layer-thickness regulating blade 57 is pressed to come into contact with the developing roller 56. The toner 53 supplied by the supply roller 55 is adhered to the surface of the developing roller 56 as a layer, the thickness of which is regulated by the layer-thickness regulating blade 57 to a predetermined value in the range of about 7 to 12 microns.

The transfer roller 60 comprises a foam rubber which includes an electrically conductive cellular elastic body typically made of silicon rubber or urethane rubber. The transfer roller 60 is rotatably provided above the photosensitive drum 20 in such a way that the transfer roller 60 is in contact with the upper side of the photosensitive drum 20. The resistance of a portion of the transfer roller 60 in contact with the upper side of the photosensitive drum 20 is in the range of about $1\times10^6$ to $1\times10^{10}$ ohms. That is, by setting the resistance of the portion of the transfer roller 60 in contact with the surface on the upper side of the photosensitive drum 20 at a large value, it is possible to prevent a photoconductive layer 22, which is formed on the surface of the photosensitive drum 20 by a voltage applied to the transfer roller 60, from being destroyed, and to allow a toner image formed on the surface of the photosensitive drum 20 to be transferred onto the paper P precisely.

On the downstream side of the photosensitive drum 20 with respect to the paper path, the fixing device 70 is provided. The fixing device 70 includes a heat roller 71, which has a generally known halogen lamp embedded therein, and a pressure roller 72. The toner image transferred onto the lower surface of the paper P is heated by the heat roller 71 and, at the same time, pressed so that the image is fixed to the surface of the paper P.

A pair of paper feeding roller 75 for feeding the paper and a ejected-paper tray 77 on which the fed paper P is stacked are both provided on the downstream side of the fixing device 70 with respect to the paper path PP. According to the preferred embodiment, as shown in FIG. 1, the paper supplying roller 13, the photosensitive drum 20, the fixing device 70 and the ejected-paper tray 77 are arranged so that a piece of paper P supplied from the paper cassette 14 is conveyed along the paper path PP which extends in a straight line.

The toner 53 used in the embodiment shown in FIG. 1 is electrically charged to the positive polarity. Typically, the toner 53 is non-magnetic single-element toner made of crushed toner or polymerized toner made of styrene acrylic having an almost spherical shape. The toner 53 includes silica as an additive doped in the pure crushed toner or the pure polymerized toner to provide fluidity. As a result, most of the toner 53 is rubbed by the developing roller 56 and the photosensitive drum 20, getting electrically charged to the positive polarity.

Next, the operation of the laser beam printer 1 having the structure described above is explained by referring to FIGS. 1 to 5.

The photosensitive drum 20 is driven to rotate in the clockwise direction as shown in FIG. 1. The supply roller 55 and the developing roller 56 are also driven to rotate in the clockwise direction as well.

Figure 4:
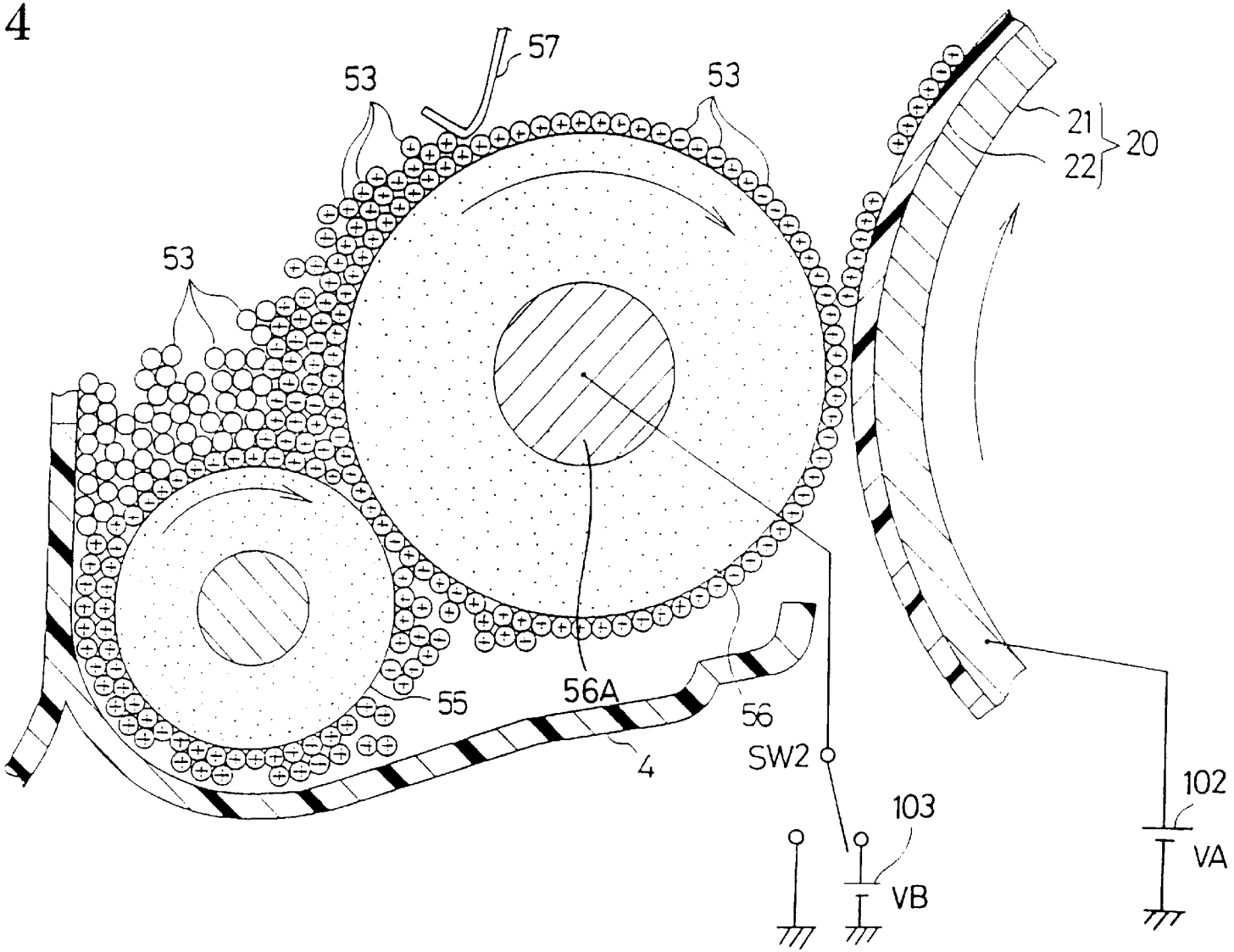
FIG. 4 is an enlarged side view of the developing unit employed in the laser beam printer of FIG. 1.

As a result, the developing process shown in FIG. 4 occurs. In the developing process, particles of the toner 53 are electrically charged to the positive polarity by mutual rubbing of the supply roller 55 and the developing roller 56 as well as pressure friction applied by the layer-thickness regulating blade 57 to the developing roller 56. The toner 53 electrically charged to the positive polarity is rubbed by the developing roller 56 and the photosensitive drum 20, getting electrically charged even further. The toner 53 is then adhered to an electrostatic latent image formed on the surface of the photosensitive drum 20 by the laser beam L.

Depending on the humidity and the temperature within the image forming apparatus, the amount of electric charge of the toner 53 varies in the range of about 25 C/g to 20 C/g. With the developing roller 56 driven to 20 rotate in the same direction as the photosensitive drum 20, the effective developing bias voltage of the developing roller 56 is about 200V so that a predetermined amount of the toner 53 (typically about 0.78 mg/cm$^2$) contributes to the development in either an environment of a low temperature and a low humidity or an environment of a high temperature and a high humidity. Due to the effective development bias voltage, a difference between the electric potential V1 at the electrostatic latent image on the surface of the photosensitive drum 20 and the electric potential Vb of the developing roller 56 is produced.

As described above, the drum offset voltage Va of the photosensitive drum 20 is about 300V. Since the electric potential VI at the electrostatic latent image on the surface of the photosensitive drum 20 is typically about 400V, the voltage Vb of the third power supply 103 applied to the developing roller 56 for development is set at about 600V to give an effective development bias voltage of 200V.

On the other hand, the discharging lamp 41 uniformly lowers the surface electric potential of the photosensitive drum 20 to a discharged potential Ve of typically about 350V, a predetermined voltage value equal to or smaller than the electric potential V1 (400V) at the electrostatic latent image on the surface of the photosensitive drum 20.

Accordingly, by applying light radiated by the discharging lamp 41 to the surface of the photosensitive drum 20, the electric potential on the surface becomes about 350V after the transfer process has been completed. For this reason, the voltage Vc of the first power supply 101 connected to the cleaning device 42 is set at a value of about 700V for blowing off residual toner 53 from the surface of the photosensitive drum 20.

As a result of setting the voltages as described above, in the absorption mode where the cleaning device 42 is connected to the ground by the switch SW1, a typical potential difference of −350V (equal to the ground electric potential (0V) minus the discharged potential Ve (350V)) allows the residual toner 53 electrically charged to the positive polarity to be absorbed from the surface of the photosensitive drum 20. In the blowing-off mode where the cleaning device 42 is connected to the first power supply 101 by the switch SW1, a typical potential difference of +350V (equal to the voltage (700V) of the first power supply 101 minus the discharged potential Ve (350V)) allows the absorbed residual toner 53 to be blown off of the cleaning device 42 onto the surface of the photosensitive drum 20.

When image forming is started in the above electric potential conditions, where residual electric charge has been eliminated from the surface of the photosensitive drum 20 by the discharging lamp 41, the surface of the photosensitive drum 20 is uniformly electrically charged to an electric potential V0 by the electric charger 40 for positive electrical charging as shown in FIG. 5A. The electric potential V0 has a value of about 1100V (equal to a voltage of 800V generated by the electric charger 40 plus the voltage Va (300V) ). In this state, the laser beam L generated by the laser generator 31 is radiated to the surface of the photosensitive drum 20 by the lenses 33 and 34 and the reflective mirrors 35 and 36 in a main scanning operation carried out by the polygon mirror 32 to form an electrostatic latent image on the surface of the photosensitive drum 20.

At that time, the voltage of an area of the photosensitive drum 20 on which the electrostatic latent image is formed drops to an electric potential V1 (400V) as shown in FIG. 5A by radiation of the laser beam L. In a state where the voltage Vb (600V) is applied to the surface of the developing roller 56 as a development bias voltage as shown in FIG. 5A, a developing process to form a toner image occurs. In this developing process, the toner 53 on the developing roller 56 is not attracted by the electrical charging voltage V0 (1100V), which is higher than the voltage of the toner 53 itself. Instead, the toner 53 is attracted by the voltage V1 (400V) of the electrostatic latent image, which is lower than the voltage of the toner 53 itself. As a result, the toner 53 of the developing roller 56 is adhered only to the electrostatic latent image formed on the surface of the photosensitive drum 20.

The toner image formed on the photosensitive drum 20 in accordance with the electrostatic latent image is transferred onto the paper P by the transfer roller 60 and then undergoes a fixing process carried out by the fixing device 70 before being ejected to the ejected-paper tray 77. The paper path PP for conveying a piece of paper P supplied from the paper cassette 14 is formed into an almost straight line. Since an image is formed while the paper P is being conveyed along the paper path PP, an image can be formed on paper, such as a postcard, or a piece of thick paper, such as an envelop or an OHP film easily without defect.

To eliminate the residual toner 53 left on the surface of the photosensitive drum 20, which was not transferred to the paper P when the paper P passed through the transfer roller 60 shown in FIG. 1, the cleaning device 42 is connected to the ground by the switch SW1 so as to generate a potential difference of −350V (equal to the ground electric potential (0V) minus the discharged potential Ve (350V)), as shown in Fig. 5B, for temporarily absorbing the residual toner 53 to the cleaning device 42 which is in the absorption mode. Then, with timing that does not disturb processes such as exposure, development and transfer, which are to be carried out next on the photosensitive drum 20, the cleaning device 42 is connected to the first power supply 101 by the switch SW1 so as to provide a potential difference of +350V (equal to the voltage Vc (700V) of the first power supply 101 minus the discharged potential Ve (350V) ) for blowing off and dispersing the toner once absorbed by the cleaning device 42 onto the surface of the photosensitive drum 20.

Thereafter, the toner 53, which was blown off onto the surface of the photosensitive drum 20, is returned to the developing device 50 while maintained at the discharged potential Ve (350V).

As the toner 53 is returned to the developing unit 50, the developing roller 56 is connected to the ground by switch SW2 in order to generate a potential difference of +350V (equal to the discharged potential Ve (350V) minus the ground electric potential (0V) for collecting the residual toner 53 left on the surface of the photosensitive drum 20 to the developing roller 56 to be recycled.

The collection of the residual toner 53 for recycling in the blowing-off mode described above can be carried out by periodically terminating the operations to form images. As an alternative, the collection of the residual toner for recycling in the blowing-off mode described above can also be carried out with timing between two consecutive operations for supplying a piece of paper P so that the image forming operations are not disturbed.

As described above, according to the laser beam printer 1 according to the preferred embodiment, only one power supply (that is, the first power supply 101) is employed for supplying power to the cleaning device 42 in order to carry out a cleaning operation using the cleanerless method. Further, since the second voltage is supplied to the photosensitive drum 20 by the second power supply 102, at the time the power supply of the laser beam printer 1 is turned on, the toner 53 from the developing roller 56 is never adhered to the surface of the photosensitive drum 20 by a potential difference due to the fact that the voltage of the developing roller 56 is set at 0V which is lower than the offset voltage Va of the photosensitive drum 20. (In the case of the preferred embodiment, the offset voltage va of the photosensitive drum 20 is +300V). Thus, unnecessary development is never carried out. As a result, when the power supply of the laser beam printer 1 is turned on, the transfer roller 60 is not contaminated by the toner 53, preventing poor printing caused by such contamination and, therefore, allowing a high quality image to be formed.

In addition, a power supply having positive and negative polarities like the conventional one is not required anymore and voltages supplied to the cleaning device 42, the photosensitive drum 20 and the developing roller 56 all have the same (positive) polarity. As a result, the structure of the power supply for generating the voltages can be made very simple.

Further, as described above, after the electric charge on the photosensitive drum 20 has been eliminated by the discharging lamp 41, the residual toner 53 is absorbed and blown out by the cleaning device 42. As a result, the toner 53 can always be blown out in a stable manner by means of a potential difference of (Vc−Ve) regardless of whether the area of the photosensitive drum 20 has completed the exposure process using the laser beam L.

If the operation to blow out the toner 53 from the cleaning device 42 is not stable, the function to absorb the residual toner 53 executed by the cleaning device 42 is also degraded so that the residual toner 53 left on the surface of the photosensitive drum 20 cannot be absorbed and remains on the surface as it is. As a result, the quality of the image deteriorates. With the preferred embodiment of the invention, however, the residual toner 53 is absorbed and blown out by using the cleaning device 42 only after the electric charge of the residual toner 53 has been eliminated by the discharging lamp 41 as described above. As a result, the quality of the image does not deteriorate, allowing a high quality image to be formed.

Furthermore, since the electric potential of the photosensitive drum 20 after the elimination of electric charge from the surface thereof is stable, the image forming apparatus offers the advantage that the electric potential Vc supplied to the cleaning device 42 by the first power supply can be set freely.

It should be noted that, while the invention has been described with reference to an illustrative preferred embodiment, the description is not intended to be construed as limiting. It is further understood by those skilled in the art that a variety of changes and modifications can thus be made to the invention without departing from the true spirit and scope thereof.

For example, the preferred embodiment has been described so far by explaining only a monochrome image form. However, the invention can also function in a color image form. In addition, the photosensitive body is implemented by the photosensitive drum 20. However, the photosensitive body can also have a belt-like shape.

Further, the direction of the relative movement of the photosensitive drum 20 can be the same as or opposite to that of the developing roller 56. Furthermore, even though the preferred embodiment has been described by explaining a laser beam printer, the explanation also applies to a copy machine, a facsimile device and other equipment that perform in the above described electrophotographic manner to form a toner image.

In addition, according to the preferred embodiment, since the second power supply 102 employs a current-to-voltage conversion device such as a varister, the second power supply can be manufactured at a low cost.

What is claimed is:

1. An image forming apparatus comprising:

a photosensitive body;

a latent image forming device that forms an electrostatic latent image on a surface of said photosensitive body, the latent image forming device including a charger;

a developing device that forms an image on the surface of said photosensitive body by developing said electrostatic latent image by using a developing agent electrically charged in a predetermined polarity in an operative state and for collecting said developing agent dispersed on the surface of said photosensitive body for recycling in an inoperative state;

a transfer device that transfers said image to a recording medium in a transfer process;

a dispersion device that absorbs said developing agent left on the surface of said photosensitive body after the transfer process from the surface of said photosensitive body by using a potential difference from said photosensitive body in an absorption mode and for blowing off and dispersing said absorbed developing agent to the surface of said photosensitive body by using another potential difference from said photosensitive body in a blowing-off mode;

a first power supply that provides to said dispersion device a first voltage different from an electric potential of the ground;

a second power supply that provides to said photosensitive body a second voltage different from said electric potential of said ground and different from said first voltage; and a switching device that switches said image forming apparatus to said absorption mode by connecting said dispersion device to the ground and for switching said image forming apparatus to said blowing-off mode by connecting said dispersion device to said first power supply.

2. The image forming apparatus according to claim 1, further comprising a third power supply that supplies a third voltage different from said electric potential of said ground to said developing device in a developing process.

3. The image forming apparatus according to claim 1, wherein said second power supply comprises a current-to-voltage conversion device.

4. The image forming apparatus according to claim 1, wherein said dispersion device comprises either a cleaning roller or a cleaning brush provided at a position facing the surface of said photosensitive body.

5. The image forming apparatus according to claim 1, further comprising a discharging device that eliminates residual electric charge left on the surface of the photosensitive body after the transfer process, said discharging device being provided between said transfer device and said dispersion device.

6. The image forming apparatus according to claim 5, wherein said discharging device eliminates said residual electric charge so that the surface electric potential of said photosensitive body becomes lower than the electric potential of said electrostatic latent image.

7. The image forming apparatus according to claim 5, wherein said discharging device comprises a discharging lamp provided between said transfer device and said dispersion device at a position facing the surface of said photosensitive body.

8. A method for an image forming apparatus comprising a photosensitive body; a latent image forming device that forms an electrostatic latent image on a surface of said photosensitive body, the latent image forming device including a charger; a developing device that forms an image on the surface of said photosensitive body by developing said electrostatic latent image by using a developing agent electrically charged in a predetermined polarity in an operative state and for collecting said developing agent dispersed on the surface of said photosensitive body for recycling in an inoperative state; and a transfer device that transfers said image to a recording medium in a transfer process, the method comprising:

absorbing onto a dispersion device said developing agent left on the surface of said photosensitive body after the process from the surface of said photosensitive body by using a potential difference from said photosensitive body in an absorption mode; and blowing off from said dispersion device and dispersing said absorbed developing agent to the surface of said photosensitive body by using another potential difference from said photosensitive body in a blowing-off mode, wherein the step of absorbing comprises connecting said dispersion device to the ground and the step of blowing off and dispersing comprises connecting said dispersion device to a first power supply, the first power supply providing to said dispersion device a first voltage different from an electric potential of the ground, the method further comprising the step of:

connecting the photosensitive body to a second power supply that provides to said photosensitive body a second voltage different from said electric potential of said ground and different from said first voltage.

9. The method according to claim 8, further comprising the step of connecting the developing device to a third power supply that supplies a third voltage different from said electric potential of said ground in a developing process.

10. The method according to claim 8, further comprising the step of eliminating residual electric charge left on the surface of the photosensitive body after the transfer process so that the surface electric potential of said photosensitive body becomes lower than the electric potential of said electrostatic latent image.

11. An image forming apparatus comprising:

a photosensitive body;

a latent image forming device that forms an electrostatic latent image on a surface of said photosensitive body, the latent image forming device including a charger;

a developing device that forms an image on the surface of said photosensitive body by developing said electrostatic latent image by using a developing agent electrically charged in a predetermined polarity in an operative state and for collecting said developing agent dispersed on the surface of said photosensitive body for recycling in an inoperative state;

a transfer device that transfers said image to a recording medium in a transfer process;

a dispersion roller that absorbs said developing agent left on the surface of said photosensitive body after the transfer process from the surface of said photosensitive body by using a potential difference from said photosensitive body in an absorption mode for blowing off and dispersing absorbed developing agent to the surface of said photosensitive body by using another potential difference from said photosensitive body in a blowing-off mode;

a first power supply that provides to said dispersion roller a first voltage different from an electric potential of the ground;

a second power supply that provides to said photosensitive body a second voltage different from said electric potential of said ground and different from said voltage; and a switching device that switches said image forming apparatus to said absorption mode by connecting said dispersion roller to the ground and for switching said image forming apparatus to said blowing-off mode by connecting said dispersion roller to said first power supply.

12. The image forming apparatus according to claim 11, wherein said dispersion roller comprises a cleaning brush provided at a position facing the surface of said photosensitive body.

13. An image forming apparatus comprising:

a photosensitive body; latent image forming means for forming an electrostatic latent image on a surface of said photosensitive body;

developing means for forming an image on the surface of said photosensitive body by developing said electrostatic latent image by using a developing agent electrically charged in a predetermined polarity in an operative state and for collecting said developing agent dispersed on the surface of said photosensitive body for recycling in an inoperative state;

transfer means for transferring said image to a recording medium in a transfer process;

dispersion means for absorbing said developing agent left on the surface of said photosensitive body after the transfer process from the surface of said photosensitive body by using a potential difference from said photosensitive body in an absorption mode and for blowing off and dispersing said absorbed developing agent to the surface of said photosensitive body by using another potential difference from said photosensitive body in a blowing-off mode;

first power supply means for providing to said dispersion means a first voltage different from an electric potential of the ground;

second power supply means for providing to said photosensitive body a second voltage different from said electric potential of said ground and different from said first voltage; and switching means for switching said image forming apparatus to said absorption mode by connecting said dispersion means to the ground and for switching said image forming apparatus to said blowing-off mode by connecting said dispersion means to said first power supply means.

14. The image forming apparatus according to claim 13, further comprising third power supply means for providing a third voltage different from said electric potential of said ground to said developing means in a developing process.

15. The image forming apparatus according to claim 13, wherein said second power supply means comprises a current-to-voltage conversion device.

16. The image forming apparatus according to claim 13, wherein said dispersion means comprises either a cleaning roller or a cleaning brush provided at a position facing the surface of said photosensitive body.

17. The image forming apparatus according to claim 13, further comprising discharging means for eliminating residual electric charge left on the surface of the photosensitive body after the transfer process, said discharging means being provided between said transfer means and said dispersion means.

18. The image forming apparatus according to claim 17, wherein said discharging means eliminates said residual electric charge so that the surface electric potential of said photosensitive body becomes lower than the electric potential of said electrostatic latent image.

19. The image forming apparatus according to claim 17, wherein said discharging means comprises a discharging lamp provided between said transfer means and said dispersion means at a position facing the surface of said photosensitive body.

* * * * *